US009091454B2

(12) United States Patent
Dempsey

(10) Patent No.: US 9,091,454 B2
(45) Date of Patent: Jul. 28, 2015

(54) AIR CHANGE RATE MEASUREMENT AND CONTROL

(75) Inventor: Daniel J. Dempsey, Carmel, IN (US)

(73) Assignee: CARRIER CORPORATION, Farmington, CT (US)

( * ) Notice: Subject to any disclaimer, the term of this patent is extended or adjusted under 35 U.S.C. 154(b) by 442 days.

(21) Appl. No.: 13/559,757

(22) Filed: Jul. 27, 2012

(65) Prior Publication Data

US 2013/0030575 A1 Jan. 31, 2013

Related U.S. Application Data

(60) Provisional application No. 61/513,136, filed on Jul. 29, 2011.

(51) Int. Cl.

| | |
|---|---|
| ***G05B 15/00*** | (2006.01) |
| ***F24F 11/04*** | (2006.01) |
| ***F24F 11/00*** | (2006.01) |

(52) U.S. Cl.

CPC ..... *F24F 11/04* (2013.01); *F24F 11/001* (2013.01); *F24F 11/0012* (2013.01); *F24F 11/0015* (2013.01); *F24F 2011/0013* (2013.01); *F24F 2011/0016* (2013.01)

(58) Field of Classification Search

USPC ..... 700/276; 702/45; 165/200

See application file for complete search history.

(56) References Cited

U.S. PATENT DOCUMENTS

| | | | | |
|---|---|---|---|---|
| 2,610,565 | A | 9/1952 | Stuart | |
| 4,700,887 | A | 10/1987 | Timmons | |
| RE33,600 | E | 6/1991 | Timmons | |
| 5,228,306 | A | 7/1993 | Shyu et al. | |
| 6,514,138 | B2 | 2/2003 | Estepp | |
| 7,178,350 | B2 | 2/2007 | Shah | |
| 7,802,734 | B2 | 9/2010 | Stanimirovic | |
| 2003/0130809 | A1* | 7/2003 | Cohen et al. | 702/45 |
| 2008/0161976 | A1* | 7/2008 | Stanimirovic | 700/276 |
| 2008/0217419 | A1 | 9/2008 | Ehlers et al. | |
| 2009/0001179 | A1* | 1/2009 | Dempsey | 236/49.3 |
| 2009/0101727 | A1 | 4/2009 | Boudreau | |
| 2010/0163633 | A1 | 7/2010 | Barrett et al. | |

* cited by examiner

*Primary Examiner* — Robert Fennema
*Assistant Examiner* — Anthony Whittington
(74) *Attorney, Agent, or Firm* — Cantor Colburn LLP

(57) ABSTRACT

A method for controlling a system includes receiving temperature and humidity measurements of supply air to a serviced space, return air from the serviced space, and outside air, wherein the outside air includes air outside the serviced space, calculating a volumetric flow rate of the outside air entering the system using the received temperature and humidity measurements of the supply air, the return air, and the outside air, calculating an air change per hour (ACH) rate in the serviced space using the calculated volumetric flow rate of the air outside the serviced space entering the system and the volume of the serviced space, and controlling the ACH rate in the serviced space.

20 Claims, 3 Drawing Sheets

AIR CHANGE RATE MEASUREMENT AND CONTROL

CROSS-REFERENCE TO RELATED APPLICATIONS

This application claims priority to U.S. provisional application 61/513,136 filed Jul. 29, 2011, the entire contents of which are incorporated herein by reference.

BACKGROUND OF THE INVENTION

When designing and operating a new residential home, the designers of the home and its heating, ventilating, and air conditioning (HVAC) systems seek to maintain a minimum air change per hour (ACH) rate of at least 0.35 ACH to maintain a healthy environment for occupants.

The ACH rate may be influenced by the ventilation airflow rate of outside air that is introduced into the space by the HVAC system by, for example, outside air intakes. The infiltration rate is another variable that influences the ACH rate. The infiltration rate is the volumetric flow rate of outside air into a building such as for example, a residential or commercial structure through windows, doors, passive ventilation, and other openings in the space. The infiltration rate may be added to the ventilation airflow rate to approximate the ACH of a space. The ventilation airflow rate should be balanced with the infiltration rate to maintain a minimum desired ACH while avoiding reducing the efficiency of the system by introducing unnecessary amounts of outside air. For example, an increased ventilation rate of about 0.10 ACH can increase annual heating energy consumption and cost by about 10%.

Previous methods for calculating the infiltration rate of a space or structure include performing a blower door test that may be performed by a technician using specialized equipment.

BRIEF DESCRIPTION OF THE INVENTION

According to one aspect of the invention, a method for controlling a system includes receiving temperature and humidity measurements of supply air to a serviced space, return air from the serviced space, and outside air, wherein the outside air includes air outside the serviced space, calculating a volumetric flow rate of the outside air entering the system using the received temperature and humidity measurements of the supply air, the return air, and the outside air, calculating an air change per hour (ACH) rate in the serviced space using the calculated volumetric flow rate of the air outside the serviced space entering the system and the volume of the serviced space, and controlling the ACH rate in the serviced space.

According to another aspect of the invention a system includes a first sensor arrangement operative to measure a temperature and humidity of outside air, the outside air including air outside a serviced space, a second sensor arrangement operative to measure a temperature and humidity of return air flowing from the serviced space, a third sensor arrangement operative to measure a temperature and humidity of supply air flowing into the serviced space, and a controller communicatively connected to the first sensor, the second sensor, and the third sensor, the controller operative to receive temperature and humidity measurements from the sensors, calculate a volumetric flow rate of the outside air entering the system using the received temperature and humidity measurements of the supply air, the return air, the outside air, and a flow rate of the supply air to the serviced space, calculate an air change per hour (ACH) rate in the serviced space using the calculated volumetric flow rate of the air outside the serviced space entering the system and the volume of the serviced space, control the ACH rate in the serviced space.

According to yet another aspect of the invention, a method for calculating an air change per hour (ACH) rate in a system includes receiving temperature and humidity measurements of supply air to a serviced space, return air from the serviced space, outside air, wherein the outside air includes air outside the serviced space, and a flow rate of the supply air to the serviced space, calculating a volumetric flow rate of the outside air entering the system using the received temperature and humidity measurements of the supply air, the return air, the outside air, and the flow rate of the supply air to the serviced space, calculating an ACH rate in the serviced space using the calculated volumetric flow rate of the air outside the serviced space entering the system and the volume of the serviced space, and outputting the calculated ACH rate.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Previous methods for calculating the air change rate per hour (ACH) of a structure or space included performing a blower door test to calculate the air infiltration rate of the space and calculating the ventilation rate of the HVAC system servicing the space. The sum of the air infiltration rate and the ventilation rate equal the ACH. The blower door test is performed by a technician using specialized equipment and may be costly to the consumer. Another disadvantage of using a blower door test to calculate the infiltration rate is that the blower door test does not allow for the HVAC system to dynamically determine the infiltration rate as conditions in the serviced space change (e.g., an open window or door), and thus, cannot dynamically adjust the ventilation rate to accommodate changes in the infiltration rate. If the ventilation rate is too low, the minimum ACH may not be met, conversely if the ventilation rate is too high, the HVAC system may waste energy by introducing unnecessary outside air into the system.

Figure 1:
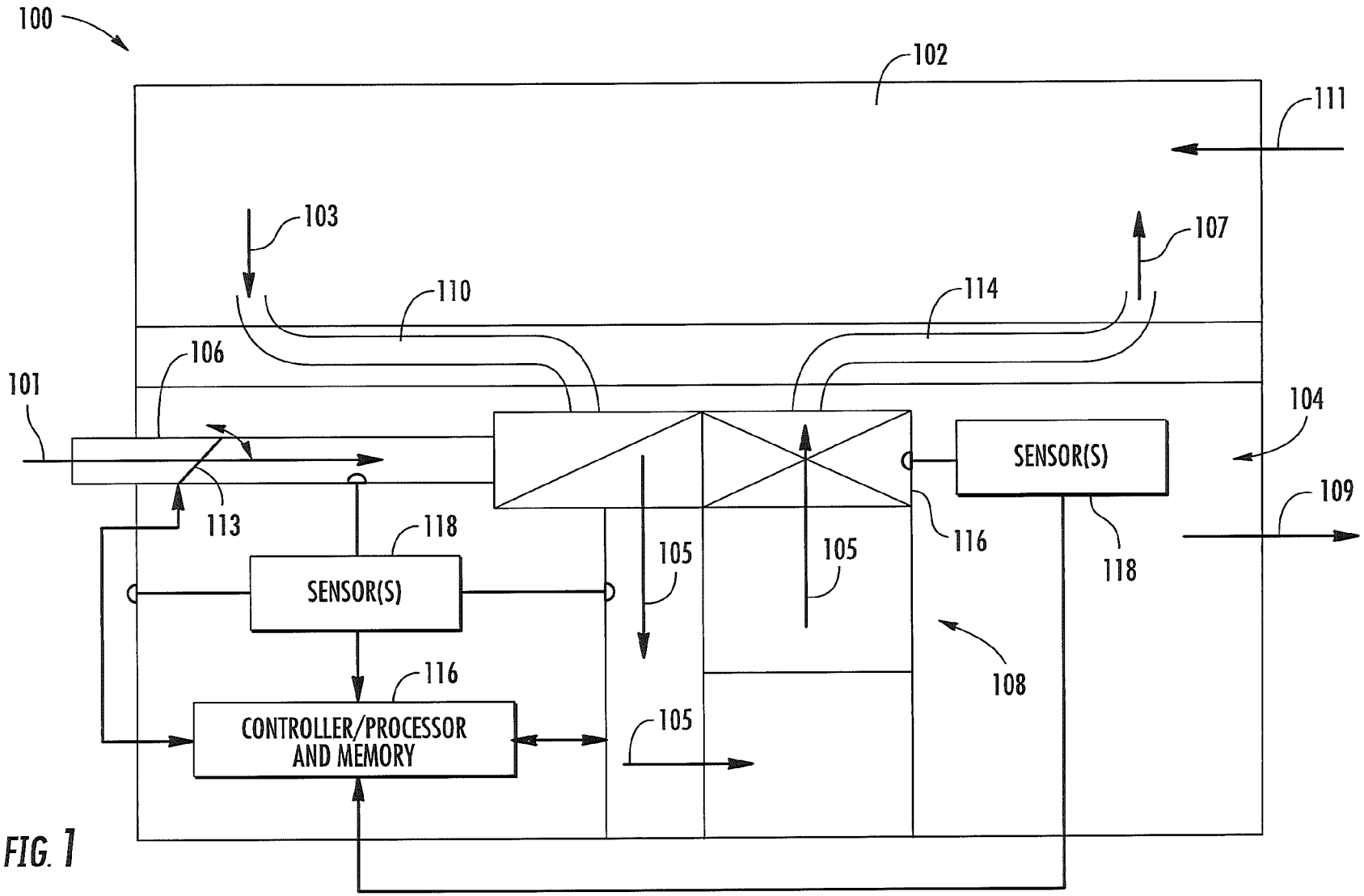
FIG. 1 illustrates an exemplary embodiment of a system.

FIG. 1 illustrates an exemplary embodiment of a system 100 that includes a serviced space 102 and an HVAC system 104. The HVAC system 104 includes a ventilation intake 106 that is communicative with the outside ambient air and an air handler portion 108. A return air portion 110 is communicative with the air in the serviced space 102 and the air handler portion 108. The air handler portion 108 may include, for example, a blower or fan, heating and/or cooling coils, and related components such as condensate drain pans and air filters. The air handler portion 108 is communicative with a supply air portion 114 that is communicative with the serviced space 102. Though the illustrated embodiment includes a ventilation intake 106, alternate embodiments may not include this feature, and thus receive intake air via the air return portion 110. The heat exchanger portion 112 may include any appropriate heating or air conditioning elements such as, for example, evaporator coils and humidifier outlets. The ventilation intake 106 defines a flow path for outside air illustrated by the arrow 101. The return air portion defines a flow path for air drawn from the serviced space 102 illustrated by the arrow 103. The arrows 105 illustrate the flow path of air through the spaces defined by the air handler portion 108, the heat exchanger portion 112, and a supply air plenum 116 that is communicative with the heat exchanger portion and the supply air portion 114. The supply air portion 114 defines a flow path of the supply air to the serviced space 102 illustrated by the arrow 107. The arrow 109 illustrates the flow of exfiltration and exhaust air, and the arrow 111 illustrates the flow of infiltration air into the serviced space 102. The HVAC system 104 may include a ventilation damper 113 that is operative to restrict the flow of outside air through the ventilation intake 106. The ventilation damper 113 of the illustrated embodiment is adjustable and may be controlled by the controller 116 to control or meter the volumetric air flow of outside air into the air handler portion 108.

The HVAC system 104 includes a controller 116 that includes a processor and memory. The controller 116 is operative to control the operation HVAC system including the air handler portion 108. The controller 116 may be communicatively connected to the ventilation damper 113 and is operative to control the position of the ventilation damper 113. The controller 116 is communicatively connected to sensors 118 that may include, for example, temperature and humidity sensors. The controller 116 may also determine flow rates of the return air, supply air, and ventilation or outside air by, for example, sensors providing feedback or open loop control methods. The sensors 118 may be arranged to sense temperature and humidity in the ventilation portion 106, or for systems that do not include a ventilation portion 106, an outdoor sensor may be used to sense outdoor ambient air temperature and humidity. A sensor 108 is arranged to sense temperature and humidity in the air handler portion 108, while a sensor 118 is arranged to sense temperature and humidity in the supply air plenum 116.

The methods described below allow the HVAC system 104 to track moisture flow through the HVAC system 104. The tracking of the moisture flow allows changes in moisture levels due to humidification or dehumidification and the HVAC system 104 supply air flow rate to calculate the amount of outside air entering the serviced space 102. The outside air entering the service space 102 may include ventilation air via the ventilation intake 106 and/or infiltration air due to envelope leakage. Once the outside air flow rate is calculated, the ACH may be calculated using the known conditioned volume of the serviced space 102. The conditioned volume of the serviced space 102 is typically determined by a technician when the HVAC system 104 is installed, and may be, for example, input by a technician and stored in the memory of the controller 116. Alternatively, in some exemplary embodiments, the airflow delivered by the air handler portion 108 may be actively measured by the controller 116 such that the conditioned volume of the serviced space 102 may be calculated.

Figure 2:
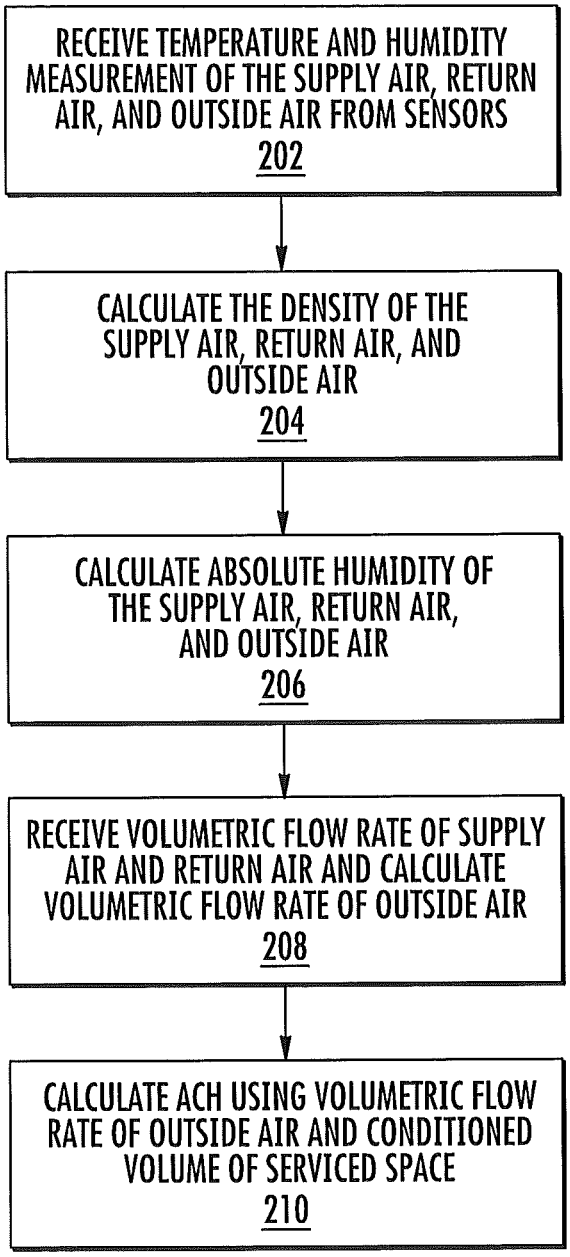
FIG. 2 illustrates a block diagram of an exemplary method that may be performed by the system of FIG. 1.

In this regard, FIG. 2 illustrates a block diagram of an exemplary method that may be performed by the HVAC system 104 using logic processed in the controller 116 (of FIG. 1). The exemplary method allows the HVAC system 104 to calculate the ACH of the serviced space 102. Referring to FIG. 2, in block 202, the controller 116 receives temperature and humidity measurements of the supply air, the return air, and the outside air from the sensors 108. In block 204, the controller 116 calculates the density of the supply air ($d_s$), the return air ($d_r$), and the outside air ($d_o$) using the sensed temperature and humidity measurements. In block 206, the controller 116 calculates the absolute humidity of the supply air ($W_s$), the return air ($W_r$), and the outside air ($W_o$) in using the sensed temperature and humidity measurements. The densities and absolute humidities may be determined by, for example, using the ideal gas law equation or using a psychrometric look up chart that may be stored in the controller 116. The controller 116 calculates the volumetric flow rate of the outside air ($CFM_o$) using the mass balance equation:

$$(CFM_s*d_s*W_s)+(CFM_o*d_o*W_o)=CFM_r*d_r*W_r$$

Where $CFM_s$ is the volumetric flow rate of the supply air and $CFM_r$ is the volumetric flow rate of the return air. Assuming $CFM_s$ is approximately or substantially equal to $CFM_r$ solving for $CFM_o$ results in the equation:

$$CFM_o=CFM_s*(d_r*W_r-d_s*W_s)/(d_o*W_o)$$

In block 210 the ACH of the serviced space 102 is calculated using the equation:

$$ACH=CFM_o*60/\text{Conditioned volume}$$

Where the conditioned volume is the volume of the serviced space 102.

Once the ACH is calculated, the controller 116 may control the ACH by, for example, controlling the position of the damper 113 to increase or decrease the $CFM_o$. Control logic that adjusts the $CFM_o$ may be used to achieve a desired ACH in the serviced space 102. For example, where ACH=($CFM_o$*60/Conditioned volume)+(volumetric flow rate of infiltration air*60/Conditioned volume) the controller 116 may increase or decrease the $CFM_o$ to achieve a desired ACH. Though the calculations described above may not account for internal moisture generation, the measurements and calculations may be performed at a time, such as, for example, night time when internal sources of moisture are usually minimized.

Figure 3:
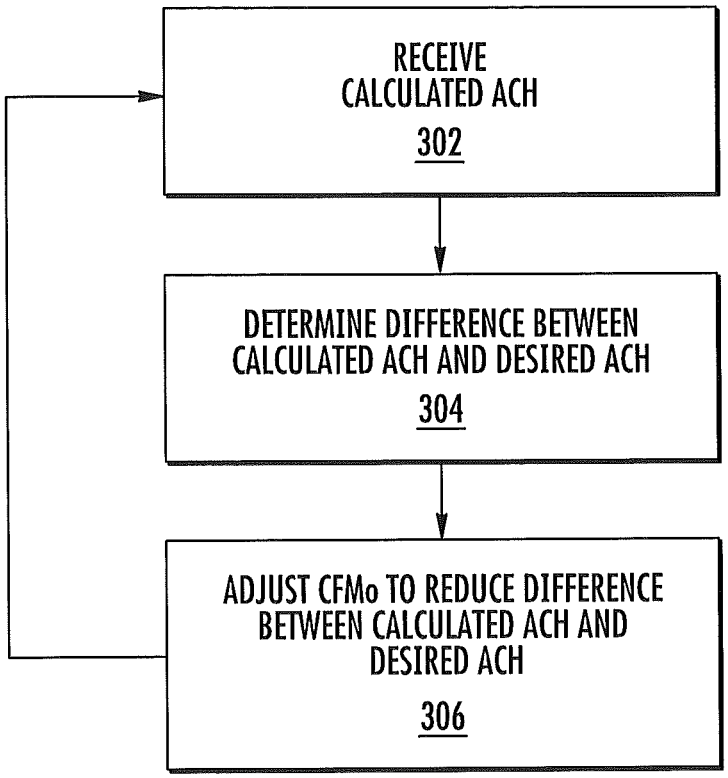
FIG. 3 illustrates a block diagram of another exemplary method that may be performed by the system of FIG. 1.

FIG. 3 illustrates a block diagram of an exemplary method for controlling ACH by the system 104 (of FIG. 1). The method may be performed by the controller 116. In block 302 the calculated ACH is received. The ACH may be calculated using the method described in FIG. 2. The difference between the calculated ACH and the desired ACH is determined in block 304. In block 306, the $CFM_o$ is adjusted to reduce the difference between the calculated ACH and the desired ACH. The $CFM_o$ may be adjusted by, for example, controlling the position of the damper 113 of the system 104.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method for controlling a system, the method comprising:

receiving temperature and humidity measurements of supply air to a serviced space, return air from the serviced space, and outside air, wherein the outside air includes air outside the serviced space, and a flow rate of the supply air to the serviced space;

calculating a volumetric flow rate of the outside air entering the system using the received temperature and humidity measurements of the supply air, the return air, the outside air, and the flow rate of the supply air to the serviced space;

calculating an air change per hour (ACH) rate in the serviced space using the calculated volumetric flow rate of the air outside the serviced space entering the system and the volume of the serviced space; and controlling the ACH rate in the serviced space.

2. A method for controlling a system, the method comprising:

receiving temperature and humidity measurements of supply air to a serviced space, return air from the serviced space, and outside air, wherein the outside air includes air outside the serviced space, and a flow rate of the supply air to the serviced space;

calculating a volumetric flow rate of the outside air entering the system using the received temperature and humidity measurements of the supply air, the return air, the outside air, and the flow rate of the supply air to the serviced space;

calculating an air change per hour (ACH) rate in the serviced space using the calculated volumetric flow rate of the air outside the serviced space entering the system and the volume of the serviced space; and controlling the ACH rate in the serviced space;

wherein the calculating the volumetric flow rate of the outside air entering the system ($CFM_o$) using the received temperature and humidity measurements of the supply air, the return air, the outside air, and the flow rate of the supply air to the serviced space comprises:

calculating a density of the supply air ($d_s$), a density of the return air ($d_r$), and a density of the outside air ($d_o$); and calculating an absolute humidity of the supply air ($W_s$), absolute humidity of the return air ($W_r$), and absolute humidity of the outside air ($W_o$);

calculating a volumetric flow rate of the supply air ($CFM_s$); and calculating the $CFM_o$, wherein $CFM_o=CFM_s*(d_r*W_r-d_s*W_s)/(d_o*W_o)$.

3. The method of claim 2, wherein the $CFM_s$ is approximately equal to a volumetric flow rate of the return air ($CFM_r$).

4. A method for controlling a system, the method comprising:

receiving temperature and humidity measurements of supply air to a serviced space, return air from the serviced space, and outside air, wherein the outside air includes air outside the serviced space, and a flow rate of the supply air to the serviced space;

calculating a volumetric flow rate of the outside air entering the system using the received temperature and humidity measurements of the supply air, the return air, the outside air, and the flow rate of the supply air to the serviced space;

calculating an air change per hour (ACH) rate in the serviced space using the calculated volumetric flow rate of the air outside the serviced space entering the system and the volume of the serviced space; and controlling the ACH rate in the serviced space;

wherein the calculating the ACH rate in the serviced space comprises calculating a product of the $CFM_o$ and 60 and dividing the product by a volume of the serviced space.

5. The method of claim 1, wherein the controlling the ACH rate in the serviced space comprises controlling the volumetric flow rate of the outside air entering the system.

6. The method of claim 1, wherein the volumetric flow rate of the outside air entering the system is controlled by an adjustable damper.

7. A system comprising:

a first sensor arrangement to measure a temperature and humidity of outside air, the outside air including air outside a serviced space;

a second sensor arrangement to measure a temperature and humidity of return air flowing from the serviced space;

a third sensor arrangement to measure a temperature and humidity of supply air flowing into the serviced space; and a controller communicatively connected to the first sensor, the second sensor, and the third sensor, the controller to receive temperature and humidity measurements from the sensors, calculate a volumetric flow rate of the outside air entering the system using the received temperature and humidity measurements of the supply air, the return air, the outside air, and a flow rate of the supply air to the serviced space, calculate an air change per hour (ACH) rate in the serviced space using the calculated volumetric flow rate of the air outside the serviced space entering the system and the volume of the serviced space, control the ACH rate in the serviced space.

8. The system of claim 7, wherein the system further comprises a heat exchanger portion to receive the return air, change the temperature of the return air and output the supply air.

9. The system of claim 7, wherein the system further comprises a heat exchanger portion to receive a portion of the outside air and the return air, heat the portion of the outside air and the return air and output the supply air.

10. The system of claim 7, wherein the system further comprises a damper to meter the volumetric flow rate of the air outside the serviced space entering the system.

11. The system of claim 10, wherein the controller is communicatively connected to the damper and is to control a position of the damper.

12. The system of claim 7, wherein the calculating the volumetric flow rate of the outside air entering the system ($CFM_o$) using the received temperature and humidity measurements of the supply air, the return air, the outside air, and the flow rate of the supply air to the serviced space comprises:

calculating a density of the supply air ($d_s$), a density of the return air ($d_r$), and a density of the outside air ($d_o$); and calculating an absolute humidity of the supply air ($W_s$), absolute humidity of the return air ($W_r$), and absolute humidity of the outside air ($W_o$);

calculating a volumetric flow rate of the supply air ($CFM_s$); and calculating the $CFM_o$, wherein $CFM_o=CFM_s*(d_r*W_r-d_s*W_s)/(d_o*W_o)$.

13. The system of claim 12, wherein the $CFM_s$ is approximately equal to a volumetric flow rate of the return air ($CFM_r$).

14. The system of claim 7, wherein the calculating the ACH rate in the serviced space comprises calculating a product of the $CFM_o$ and 60 and dividing the product by a volume of the serviced space.

15. A method for calculating an air change per hour (ACH) rate in a system, the method comprising:

receiving temperature and humidity measurements of supply air to a serviced space, return air from the serviced space, outside air, wherein the outside air includes air outside the serviced space, and a flow rate of the supply air to the serviced space;

calculating a volumetric flow rate of the outside air entering the system using the received temperature and humidity measurements of the supply air, the return air, the outside air, and the flow rate of the supply air to the serviced space;

calculating an ACH rate in the serviced space using the calculated volumetric flow rate of the air outside the serviced space entering the system and the volume of the serviced space; and outputting the calculated ACH rate.

16. A method for calculating an air change per hour (ACH) rate in a system, the method comprising:

receiving temperature and humidity measurements of supply air to a serviced space, return air from the serviced space, outside air, wherein the outside air includes air outside the serviced space, and a flow rate of the supply air to the serviced space;

calculating a volumetric flow rate of the outside air entering the system using the received temperature and humidity measurements of the supply air, the return air, the outside air, and the flow rate of the supply air to the serviced space;

calculating an ACH rate in the serviced space using the calculated volumetric flow rate of the air outside the serviced space entering the system and the volume of the serviced space; and outputting the calculated ACH rate;

wherein the calculating the volumetric flow rate of the outside air entering the system ($CFM_o$) using the received temperature and humidity measurements of the supply air, the return air, the outside air, and the flow rate of the supply air to the serviced space comprises:

calculating a density of the supply air ($d_s$), a density of the return air ($d_r$), and a density of the outside air ($d_o$); and calculating an absolute humidity of the supply air ($W_s$), absolute humidity of the return air ($W_r$), and absolute humidity of the outside air ($W_o$);

calculating a volumetric flow rate of the supply air ($CFM_s$); and calculating the $CFM_o$, wherein $CFM_o=CFM_s*(d_r*W_r-d_s*W_s)/(d_o*W_o)$.

17. The method of claim 16, wherein the $CFM_s$ is approximately equal to a volumetric flow rate of the return air ($CFM_r$).

18. A method for calculating an air change per hour (ACH) rate in a system, the method comprising:

receiving temperature and humidity measurements of supply air to a serviced space, return air from the serviced space, outside air, wherein the outside air includes air outside the serviced space, and a flow rate of the supply air to the serviced space;

calculating a volumetric flow rate of the outside air entering the system using the received temperature and humidity measurements of the supply air, the return air, the outside air, and the flow rate of the supply air to the serviced space;

calculating an ACH rate in the serviced space using the calculated volumetric flow rate of the air outside the serviced space entering the system and the volume of the serviced space; and outputting the calculated ACH rate;

wherein the calculating the ACH rate in the serviced space comprises calculating a product of the $CFM_o$ and 60 and dividing the product by a volume of the serviced space.

19. The method of claim 15, wherein the outputting the calculated ACH rate includes outputting the ACH rate to a user on a display.

20. The method of claim 1, further comprising:

mixing the outside air with the return air.

* * * * *